US009294838B2

(12) United States Patent
Christoph

(10) Patent No.: US 9,294,838 B2
(45) Date of Patent: Mar. 22, 2016

(54) SOUND CAPTURE SYSTEM

(71) Applicant: Harman Becker Automotive Systems GmbH, Karlsbad (DE)

(72) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 174 days.

(21) Appl. No.: 14/104,138

(22) Filed: Dec. 12, 2013

(65) Prior Publication Data

US 2014/0177867 A1 Jun. 26, 2014

(30) Foreign Application Priority Data

Dec. 20, 2012 (EP) ..... 12198502

(51) Int. Cl.
*H04R 3/00* (2006.01)
*H04R 5/027* (2006.01)

(52) U.S. Cl.
CPC ..... *H04R 3/005* (2013.01); *H04R 5/027* (2013.01); *H04S 2400/15* (2013.01)

(58) Field of Classification Search
CPC ..... H04S 7/302; H04S 2420/01; H04S 7/301; H04S 7/303; H04S 7/30
USPC ..... 381/303
See application file for complete search history.

(56) References Cited

U.S. PATENT DOCUMENTS

2003/0147539 A1* 8/2003 Elko et al. ..... 381/92
2008/0170716 A1 7/2008 Zhang
2008/0247565 A1* 10/2008 Elko et al. ..... 381/92
2008/0267422 A1* 10/2008 Cox ..... 381/92
2010/0142732 A1* 6/2010 Craven et al. ..... 381/170

FOREIGN PATENT DOCUMENTS

EP 0869697 A2 10/1998
EP 2360940 A1 8/2011
WO 2009077152 A1 6/2009

OTHER PUBLICATIONS

European Search Report for corresponding Application No. EP 12 198 502.2-1910, mailed Mar. 26, 2013, 14 pages.
Hulsebos, "Auralization using Wave Field Synthesis", 207 pages, 2004.
Rafaely, "Analysis and Design of Spherical Microphone Arrays", IEEE, vol. 13, No. 1, Jan. 2005, p. 135-143.
(Continued)

*Primary Examiner* — Mark Blouin
(74) *Attorney, Agent, or Firm* — Brooks Kusham P.C.

(57) ABSTRACT

A sound capture system is disclosed that includes an open-sphere microphone array where at least four omnidirectional microphones providing at least four output signals are disposed around a point of symmetry and an evaluation circuit that is connected to the at least four microphones disposed around the point of symmetry and that is configured to superimpose the output signal of each of the at least four microphones disposed around the point of symmetry with the output signal of one of the other microphones to form at least four differential microphone constellations providing at least four output signals, each differential microphone constellation having an axis along which it exhibits maximum sensitivity.

20 Claims, 3 Drawing Sheets

(56) References Cited

OTHER PUBLICATIONS

Farina et al., "A Spherical Microphone Array for Synthesizing Virtual Directive Microphones in Live Broadcasting and in Post Production", AES 40th International Conference, Tokyo, Japan, Oct. 8-10, 2010, p. 1-11.
Meyer et al., "A Highly Scalable Spherical Microphone Array Based on an Orthodonormal Decomposition of the Soundfield", IEEE, 2002, pp. 1781-1784.
Moreau et al., "3D Sound Field Recording with Higher Order Ambisonics—Objective Measurements and Validation of Spherical Microphone", AES 120th Convention, May 20-23, 2006, Paris, 24 pages.
Poletti, "Three-Dimensional Surround Sound Systems Based on Spherical Harmonics", J. Audio Eng. Soc., vol. 53, No. 11, Nov. 2005, pp. 1004-1025.
Moreau et al., "Study of Higher Order Ambisonic Microphone", Jan. 2004, 2 pages.
Meyer et al., "Spherical Microphone Array for Spatial Sound Recording", AES 115th Convention, New York, NY, Oct. 10-13, 2003, 9 pages.
Rafaely et al., "Spatial Aliasing in Spherical Microphone Arrays", IEEE, vol. 55, No. 3, Mar. 2007, p. 1003-1010.
Plessas, "Rigid Sphere Microphone Arrays for Spatial Recording and Holography", Nov. 16, 2009, 70 pages.
Epain et al., "Improving Spherical Microphone Arrays", AES 124th Convention, Amsterdam, May 17-20, 2008, 9 pages.
Meyer et al., "Handling Spatial Aliasing in Spherical Array Applications," IEEE, 2008, p. 1-4.
Li et al., "Flexible and Optimal Design of Spherical Microphone Arrays for Beamforming", IEEE, Feb. 2007, p. 1-13.
Lekkala et al., "EMFi—New Electret Material for Sensors and Actuators", IEEE, 1999, p. 743-746.
Poletti, "Effect of Noise and Transducer Variability on the Performance of Circular Microphone Arrays", J. Audio Eng. Soc., vol. 53, No. 5, May 2005, pp. 371-384.
Meyer, "Beamforming for a circular microphone array mounted on spherically shaped objects", J. Accoust. Soc. Am., 109, Jan. 2001, p. 185-193.
Huang et al., "Audio Signal Processing for Next-Generation Multimedia Communication Systems", 2004, 389 pages, Kluwer Academic Publishers, Boston, MA.
Teutsch, "Wavefield Decomposition Using Microphone Arrays and Its Application to Acoustic Scene Analysis", 2005, 279 pages, Erlangen, Germany.
Extended European Search Report for corresponding Application No. 15160861.9, mailed Jul. 6, 2015, 6 pages.

* cited by examiner

SOUND CAPTURE SYSTEM

CROSS-REFERENCE TO RELATED APPLICATIONS

This application claims priority to EP Application No. 12 198 502.2-1910, filed Dec. 20, 2012, the disclosure of which is incorporated in its entirety by reference herein.

TECHNICAL FIELD

The embodiments disclosed herein refer to sound capture systems, particularly to sound capture systems that employ open-sphere microphone arrays.

BACKGROUND

Spherical microphone arrays, including those that are rotationally symmetric, can offer virtually any spatial directivity and are thus attractive in various applications such as beamforming, speech enhancement, spatial audio recordings, sound-field analysis, and plane-wave decomposition. Two spherical microphone array configurations are commonly employed. The sphere may exist physically, or may merely be conceptual. In the first configuration, the microphones are arranged around a rigid sphere (e.g., made of wood or hard plastic or the like). In the second configuration, the microphones are arranged in a free-field around an "open" sphere, referred to as an "open-sphere configuration." Although the rigid-sphere configuration provides a more robust numerical formulation, the open-sphere configuration might be more desirable in practice at low frequencies, where large spheres are realized.

In open-sphere configurations, most practical microphones have a drum-like or disc-like shape. In practice, it would be desired to move the capsules closer to the center of the array in order to maintain the directional performance of the array up to the highest audio frequencies. So for microphones of a given size, the gap between adjacent microphones will become smaller as they are pulled in, perhaps to the point where adjacent microphones touch.

This situation worsens when directional microphones (i.e., microphones having an axis along which they exhibit maximum sensitivity) are employed, as directional microphones are commonly much bulkier than omnidirectional microphones (i.e., microphones having a sensitivity independent of the direction). An exemplary type of directional microphone is called a shotgun microphone, which is also known as a line plus gradient microphone. Shotgun microphones may comprise an acoustic tube that by its mechanical structure reduces noises that arrive from directions other than directly in front of the microphone along the axis of the tube. Another exemplary directional microphone is a parabolic dish that concentrates the acoustic signal from one direction by reflecting away other noise sources coming from directions other than the desired direction.

A sound capture system that avoids the dimensional problems noted above, particularly with an open-sphere microphone array, is desired.

SUMMARY

A sound capture system includes an open-sphere microphone array and an evaluation circuit. With the open-sphere microphone, at least four omnidirectional microphones provide at least four output signals that are disposed around a point of symmetry. The evaluation circuit is connected to the at least four microphones disposed around the point of symmetry. The evaluation circuit is configured to superimpose the output signal of each of the at least four microphones disposed around the point of symmetry with the output signal of one of the other microphones to form at least four differential microphone constellations providing at least four output signals. Each differential microphone constellation includes an axis along which it exhibits maximum sensitivity.

BRIEF DESCRIPTION OF THE DRAWINGS

The figures identified below are illustrative of some embodiments of the invention. The figures are not intended to limit the invention recited in the appended claims. The embodiments, both as to their organization and manner of operation, together with further objects and advantages thereof, may best be under-stood with reference to the following description, taken in connection with the accompanying drawings, in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Microphone sensitivity is typically measured with a 1 kHz sine wave at a 94 dB sound pressure level (SPL), or 1 Pascal (Pa) of pressure. The magnitude of the output signal from a microphone with that input stimulus is a measure of its sensitivity. The sensitivity of an analog microphone is typically specified in logarithmic constellations of dBV (decibels with respect to 1 V).

Ideally, an omnidirectional microphone would pick up sound in a perfect circle around its center. In real-world use, this type of microphone cannot pick up sound perfectly from every direction. It can also cut out some high and low frequencies, and sound coming from an extreme angle may not be reliably detected. The design of omnidirectional microphones contrasts with the design of unidirectional microphones, which only pick up sound from a more targeted source. There are several different types of unidirectional microphones, each classified by its polar pattern or directionality, the shape created when the sound pickup is mapped on a flat plane. Unidirectional microphones are, for example, shotgun microphones and cardioids, which are named for the heart-like shape of their polar pattern.

Figure 1:
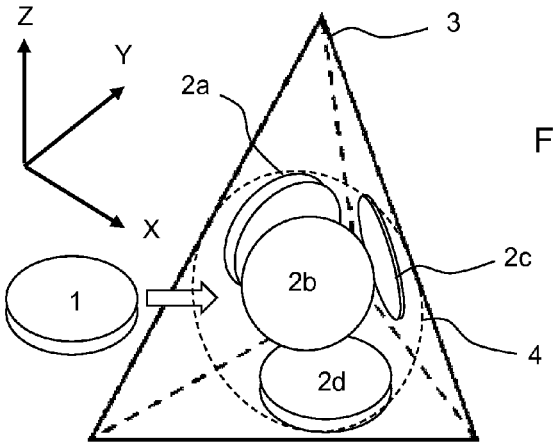
FIG. 1 is a schematic representation of an open-sphere microphone array with five omnidirectional microphones.

FIG. 1 shows an open-sphere microphone array in which four omnidirectional microphones 2*a*, 2*b*, 2*c*, 2*d* are disposed around a point of symmetry and omnidirectional microphone 1 (also referred to as central microphone) is disposed at the point of symmetry. In particular, the four microphones 2*a*, 2*b*, 2*c* and 2*d* are arranged at the centers of the surface areas of virtual tetrahedron 3 and are thus mutually disposed at 120° around the central point of symmetry (micro-phone 1) on virtual sphere 4. The point of symmetry is given by the centroid of tetrahedron 3. The microphones 1, 2*a*, 2*b*, 2*c* and 2*d* may be planar capsules that are represented diagrammatically by discs.

Figure 2:
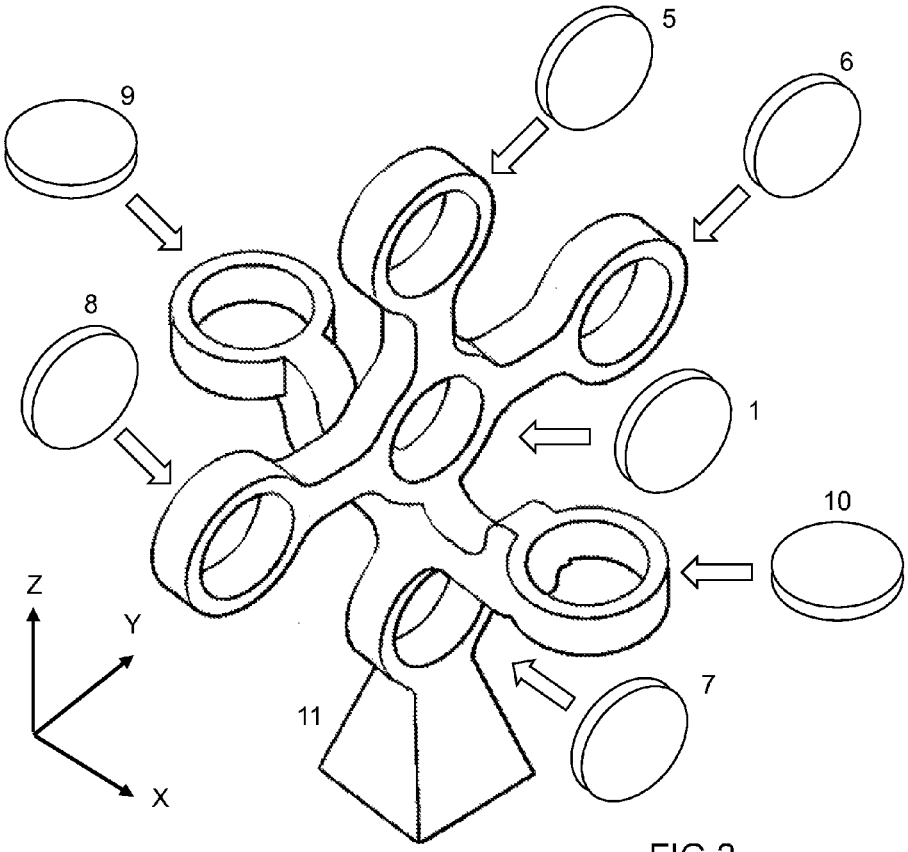
FIG. 2 is a schematic representation of an open-sphere microphone array with seven omnidirectional microphones.

FIG. 2 shows an open-sphere microphone array in which six omnidirectional microphones 5, 6, 7, 8, 9, 10 are disposed around a central omnidirectional microphone 1 disposed at the point of symmetry. Four (5, 6, 7, 8) of the six microphones 5, 6, 7, 8, 9 and 10 and central microphone 1 are arranged in the y-z plane. The other two (9, 10) of the six microphones 5, 6, 7, 8, 9 and 10 are arranged in the x-y plane. In the present example, microphones 1, 6 and 8 are arranged in the y-z plane. Naturally the x-y plane and y-z plane are arranged perpendicular to each other. The six microphones 5, 6, 7, 8, 9 and 10 disposed around the point of symmetry and microphone 1 disposed at the point of symmetry may be planar microphones as in the example of FIG. 1. The central microphone 1 and the four microphones 5, 6, 7 and 8 that are disposed around the point of symmetry and arranged in the x-y plane may be coplanar. The two (9, 10) of the six microphones 5, 6, 7, 8, 9 and 10 that are disposed around the point of symmetry and arranged in the y-z plane are coplanar. The microphones 1 and 5 through 10 are inserted in through-holes of support 11 and fixed therein. Support 11 has a tree-like structure in which the through-holes may be positioned substantially in the center and at the end of the branches so that the center of microphone 1 is disposed at the point of symmetry of the virtual sphere and the centers of the planar microphones 5 through 10 are disposed on the sphere and may be disposed on both the x-y and y-z plane. FIG. 2 shows the support 11 before the microphones 1 and 5 through 10 have been inserted.

Alternatively, the central omnidirectional microphone 1 of the microphone array of FIG. 2 may be omitted, and instead of the pairs of microphones that form differential microphone constellations as outlined above, namely the pairs of microphones 5 and 1; 6 and 1; 7 and 1; 8 and 1; 9 and 1; and 10 and 1, may be formed as pairs from the microphones 5-10, and the pair of microphones 5 and 7; 6 and 8; 7 and 5; 8 and 6; 9 and 10; and 10 and 9, may form six corresponding differential microphone constellations. A corresponding evaluation circuit is discussed below with reference to FIG. 6.

Figure 3:
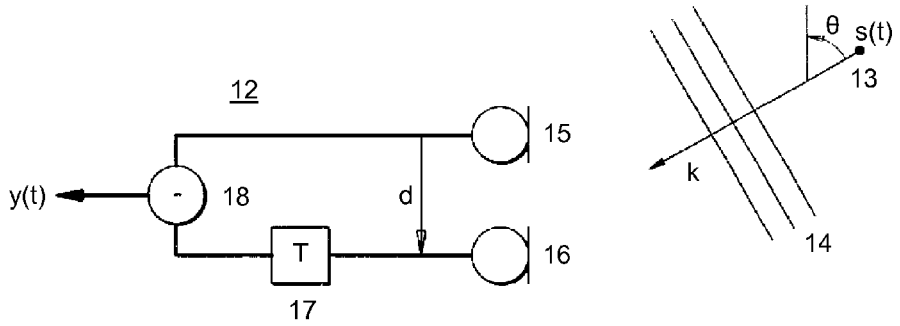
FIG. 3 is a schematic representation of a first-order differential microphone constellation.

FIG. 3 is a schematic representation of a first-order differential microphone constellation 12 for receiving audio signal s(t) from audio source 13 at a distance where far-field conditions are applicable. When far-field conditions apply, the audio signal arriving at differential microphone array 12 can be treated as plane wave 14. Differential microphone array 12 comprises the two zero-order microphones 15 and 16 separated by a distance d. Electrical signals generated by microphone 16 are delayed by delay time T at delay path 17 before being subtracted from the electrical signals generated by microphone 15 at subtraction node 18 to generate output signal y(t). The magnitude of the frequency and angular-dependent response H(f, θ) of the first-order differential microphone array 12 for a signal point source at a distance where far-field conditions are applicable can be written according to Equation (1) as follows:

$$H(f,\theta)=|Y(f,\theta)/S(f)|=|1-e^{(-j(2\pi fT+kd\cos\theta))}|=2\sin(\pi f(T+(d\cdot\cos\theta)/c)) \quad (1)$$

in which Y(f, θ) is the spectrum of the differential microphone array output signal y(t), S(j) is the spectrum of the signal source, k is the wave number k=2πf/c, c is the speed of sound, and d is the displacement between microphones 15 and 16. As indicated by the term Y(f, θ), the differential microphone array output signal is dependent on the angle θ between the displacement vector d and the sound vector (k in FIG. 3), as well as on the frequency f.

Note that the amplitude response of the first-order differential array rises linearly with frequency. This frequency dependence can be corrected for by applying a first-order low-pass filter at the array output.

The delay T can be calculated according to T=d/c so that the directivity response D can then be expressed as follows:

$$D(\theta)=(T/(T+d/c))+(1-(T/(T+d/c))\cdot\cos\theta \quad (2)$$

Accordingly, omnidirectional microphones 15 and 16 are arranged as an array of two microphones referred to herein as a "pair of microphones." By arranging and connecting the microphones as differential microphones in the way described above in connection with FIG. 3, the two omnidirectional microphones 15 and 16 form a unidirectional microphone constellation, (i.e., the two omnidirectional microphones together behave like one unidirectional microphone that has an axis along which it exhibits maximum sensitivity).

Figure 4:
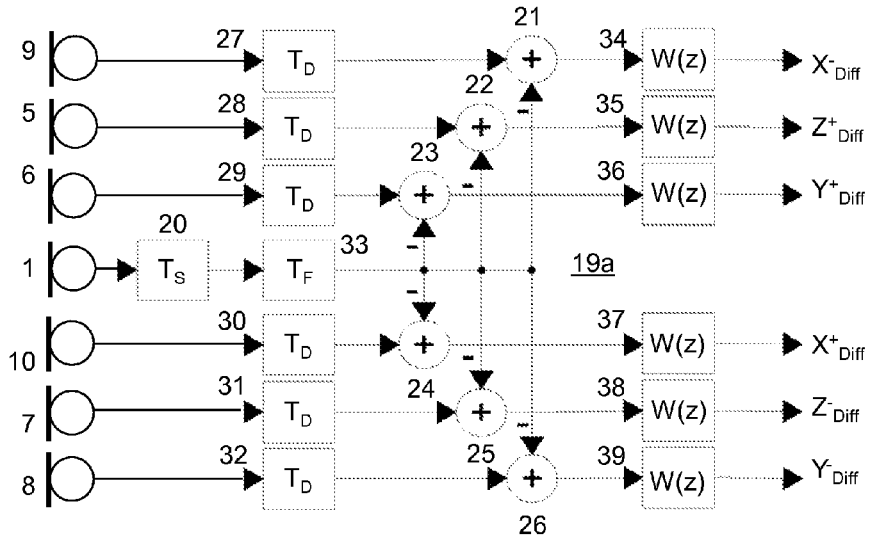
FIG. 4 is a schematic representation of a first part of an evaluation circuit providing six unidirectional microphone constellations.

Referring now to FIG. 4, six pairs of omnidirectional microphones are connected to form six unidirectional microphone constellations, as shown in the first alternative of the array described above with reference to FIG. 2. In particular, evaluation circuit 19, a first part of which is shown in FIG. 4 as differential microphone constellation 19*a*, is connected to the six microphones 5 through 10 in the arrangement shown in FIG. 2 in which the six microphones 5 through 10 are disposed around the point of symmetry and microphone 1 is disposed at the point of symmetry. The differential microphone constellation 19*a* superimposes the output signal of each of the microphones 5 through 10 disposed around the point of symmetry with the output signal of microphone 1 disposed at the point of symmetry to form six differential microphone constellations providing six output signals.

In the configuration shown in FIG. 4, differential microphone constellation 19*a* includes a delay path configured to delay the output signal from microphone 1 disposed at the point of symmetry to generate a delayed output signal of the microphone 1. Differential microphone constellation 19*a* further includes subtraction nodes 21-26 that generate first directional output signals based on differences between the output signals of the six microphones 5-10 disposed around the point of symmetry and the delayed output signal of microphone 1 disposed at the point of symmetry. Furthermore, subtraction nodes 21-26 may subtract the (delayed) output signals of microphone 1 from the (delayed) output signals of microphones 5-10, as shown (e.g., when the delay time T, with which the signal from microphone 1 is delayed), is provided by a fractional-delay FIR filter. Fractional-delay finite-impulse response (FIR) filters are a type of digital filter designed for bandlimited interpolation. Bandlimited interpolation is a technique for evaluating a signal sample at an arbitrary point in time, even if it is located somewhere between two sampling points. The value of the sample obtained is exact because the signal is bandlimited to half the sampling rate (Fs/2). This implies that the continuous-time signal can be exactly regenerated from the sampled data. Once the continuous-time representation is known, it is easy to evaluate the sample value at any arbitrary time, even if it is "fractionally delayed" from the last integer multiple of the sampling interval. FIR or IIR filters that are used for this effect are termed fractional-delay filters.

Differential microphone constellation 19*a* may further include (e.g., when the delay T, with which the signal from microphone 1 is delayed, is provided by or under the participation of a fractional-delay FIR filter) the six delays paths 27-32, which are connected downstream of the six microphones 5-10 and which delay the output signals from the six microphones 5 through 10 to generate delayed output signals of the six microphones 5 through 10. The delayed output signals of the six microphones 5-10 are provided to subtraction nodes 21-26. Differential microphone constellation 19*a* may also include a further delay path 33 for delaying the output signal from microphone 1 disposed at the point of symmetry to generate a delayed output signal of the microphone 1.

Differential microphone constellation 19*a* of FIG. 4 may further include filter paths that filter, with transfer function W(z), the first directional output signals provided by the first subtraction nodes to provide second directional output signals. The filter paths may include low-pass filters or otherwise may exhibit low-pass behavior.

Differential microphone constellation 19*a* may employ digital signal processing under a certain sampling rate. Delay paths 27-32 and/or the third delay 20 may have a delay time that is a whole-number multiple of the sampling rate.

In the exemplary differential microphone constellation 19*a* of FIG. 4, the second directional output signals are the same as those provided by six unidirectional microphones placed at the locations of microphones 5-10 but without microphone 1. The second directional output signals, referred to as $X_{-Diff}$, $Z_{+Diff}$, $Y_{+Diff}$, $X_{+Diff}$, $Z_{-Diff}$ and $Y_{-Diff}$, corresponding to microphones 9, 5, 6, 10, 7 and 8, respectively, can be expressed as follows:

$$X_{-Diff}[n]=S_9(\theta_9,\phi_9) \tag{3}$$

$$Z_{+Diff}[n]=S_5(\theta_5,\phi_5) \tag{4}$$

$$Y_{+Diff}[n]=S_6(\theta_6,\phi_6) \tag{5}$$

$$X_{+Diff}[n]=S_{10}(\theta_{10},\phi_{10}) \tag{6}$$

$$Z_{-Diff}[n]=S_7(\theta_7,\phi_7) \tag{7}$$

$$Y_{-Diff}[n]=S_8(\theta_8,\phi_8) \tag{8}$$

In the differential microphone constellation 19*a* of FIG. 4, the delay T for the output signal of microphone 1 is split into two partial delays, the sample delay $T_S$ and the fractional delay $T_F$, in which:

$$T=T_S+T_F. \tag{9}$$

The background of splitting delay T is that when employing digital signal processing, a sampled analog signal is converted into digital signals with a sample rate $f_S$ [1/s]. Delays that are whole-number multiples of the inverse sample rate can easily be realized. In practice, however, the required delay T is often not. So the required delay T is split into the sample delay $T_S$, which is a whole-number multiple of the inverse sample rate fs, and the fractional delay $T_F$, which is not a whole-number multiple of the inverse sample rate fs, in which $0<T_F<1$ of the inverse sample rate. Such a fractional delay $T_F$ can be realized by way of phase shifting a FIR filter (FIR) that forms an ideal low-pass filter, also known as ideal interpolator, whose impulse response is a sinus cardinalis (si) function, by the fractional delay $T_F$ according to:

$$T_F=T-T_S=d\cdot f_S/c \text{ floor}(d\cdot f_S/c) \text{ with } si(t-T_F)=\sin(t-T_F)/(t-T_F). \tag{10}$$

Subsequently, the fractional delay $T_F$ is sampled with the sampling rate fs and afterwards windowed with a Hamming window to suppress disturbing side effects such as the Gibbs phenomenon.

For an FIR filter providing the fractional delay $T_F+T_D$, where $T_D=L/2$, the following applies, in which the filter coefficients of the FIR form a vector $h_L=[h_0, h_1 \ldots h_{L-1}]^T$ with the length L:

$$h_n=W(n)\cdot si(n-L/2-T_F), \text{ where} \tag{11}$$

$$W(n)=0.54-0.46\cos(2\pi n/L) \text{ (Hamming window)}, \tag{12}$$

in which n=0, . . . , L−1; $h_n$ is the nth filter coefficient of the fractional-delay FIR filter; and W(n) is the nth weighting factor of the window function used.

Thus, the microphones 5 through 10 are delayed by the excessive delay TD, arising out of the design of the fractional-delay FIR filter.

Figure 5:
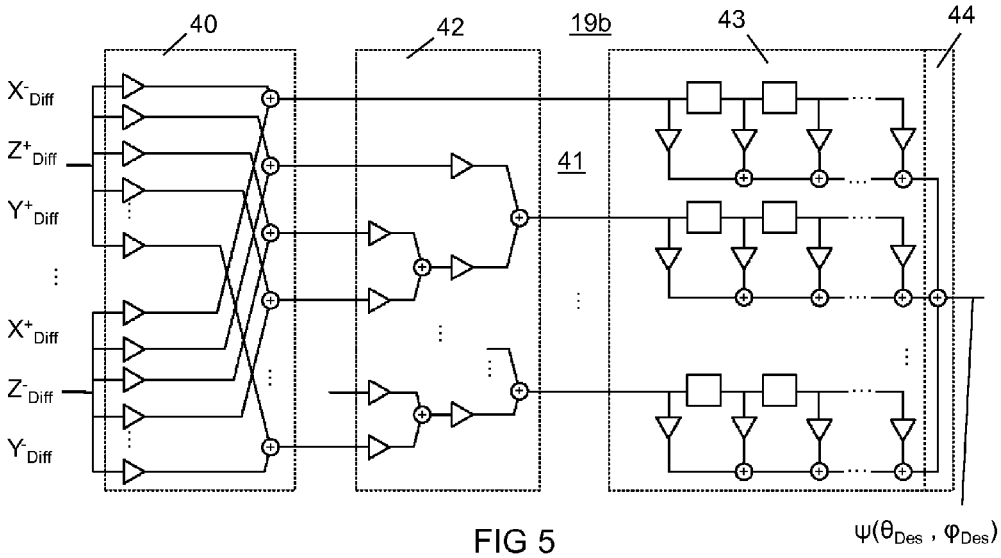
FIG. 5 is a schematic representation of a second part of the evaluation circuit providing a modal beamformer constellation.

Differential microphone constellation 19*a* may additionally superimpose the six second directional output signals, referred to as $X_{-Diff}$, $Z_{+Diff}$, $Y_{+Diff}$, $X_{+Diff}$, $Z_{-Diff}$ and $Y_{-Diff}$, provided by the six differential microphone constellations to provide input signals to modal beamformer constellation 19*b* (see FIG. 5), which forms the second part of evaluation circuit 19. Modal beamformer constellation 19*b* may have any type of omnidirectional or unidirectional characteristic dependent on control signals. A circuit that provides the beamforming functionality is shown in FIG. 5.

Modal beamformer constellation 19*b* receives the six input signals provided by the six differential microphone constellations, transforms the six input signals into spherical harmonics, and steers the spherical harmonics to provide steered spherical harmonics.

Modal beamforming is a powerful technique in beampattern design. Modal beamforming is based on an orthogonal decomposition of the sound field, where each component is multiplied by a given coefficient to yield the desired pattern. The underlying procedure of modal beamforming is described in more detail, for example, in WO 2003/061336 A1.

Modal beamformer constellation 19*b* is connected downstream of differential microphone constellation 19*a* and receives the output signals thereof (i.e., signals $X_{-Diff}$, $Z_{+Diff}$, $Y_{+Diff}$, $X_{+Diff}$, $Z_{-Diff}$ and $Y_{-Diff}$). Modal beamformer constellation 19*b* includes modal decomposer (i.e., eigenbeam former) 40 and may include steering constellation 42, which form modal beamformer 41, as well as compensation (modal weighting) constellation 43 and summation node 44. Steering constellation 42 is responsible for steering the look direction by $\theta_{Des}$ and $\phi_{Des}$.

Modal decomposer 40 in modal beamformer constellation 19*b* of FIG. 5 is responsible for decomposing the sound field, which is picked up by the microphones and decomposed into the different eigenbeam outputs corresponding to the zero-order, first-order and second-order spherical harmonics. This can also be seen as a transformation, where the sound field is transformed from the time or frequency domain into the "modal domain." To simplify a time-domain implementation, one can also work with the real and imaginary parts of the spherical harmonics. This will result in real-value coefficients, which are more suitable for a time-domain implementation. If the sensitivity equals the imaginary part of a spherical harmonic, then the beampattern of the corresponding array factor will also be the imaginary part of this spherical harmonic.

Compensation constellation 43 compensates for a frequency-dependent sensitivity over the modes (eigenbeams)

(i.e., modal weighting over frequency) to the effect that the modal composition is adjusted, such as equalized. Summation node 44 performs the actual beamforming for the sound capture system. Summation node 44 sums up the weighted harmonics to yield beamformer output $\psi(\theta_{Des}, \phi_{Des})$ Referring to FIG. 5, signals $X_{-Diff}$, $Z_{+Diff}$, $Y_{+Diff}$, $X_{+Diff}$, $Z_{-Diff}$ and $Y_{-Diff}$ correspond to the sound incidents at the locations of the (virtual) sensors established by the six unidirectional microphone constellations as generated by differential microphone constellation 19*a* of FIG. 4. Modal decomposer 40 decomposes the signals $X_{-Diff}$, $Z_{+Diff}$, $Y_{+Diff}$, $X_{+Diff}$, $Z_{-Diff}$ and $Y_{-Diff}$ into a set of spherical harmonics (i.e., the six output signals provided by differential microphone constellation 19*a* are transformed into the modal domain). These modal outputs are then processed by beamformer 41 to generate a representation of an auditory scene. An auditory scene is a sound environment relative to a listener/microphone that includes the locations and qualities of individual sound sources. The composition of a particular auditory scene will vary from application to application. For example, depending on the application, beamformer 41 may simultaneously generate beampatterns for two or more different auditory scenes, each of which can be independently steered to any direction in space.

Beamformer 41 exploits the geometry of the spherical array of FIG. 2 and relies on the spherical harmonic decomposition of the incoming sound field by decomposer 40 to construct a desired spatial response. Beamformer 41 can provide continuous steering of the beampattern in 3-D space by changing a few scalar multipliers, while the filters determining the beampattern itself remain constant. The shape of the beampattern is invariant with respect to the steering direction. Instead of using a filter for each audio sensor, as in a conventional filter-and-sum beamformer, beamformer 41 in the present example needs only one filter per spherical harmonic, which can significantly reduce the computational cost.

Figure 6:
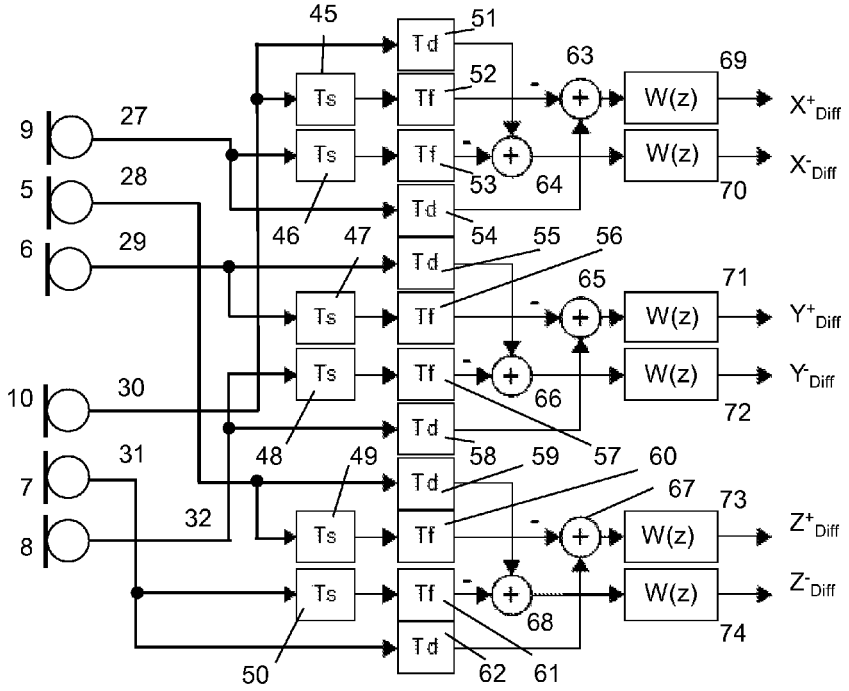
FIG. 6 is a schematic representation of an alternative to the first part of the evaluation circuit of FIG. 4.

FIG. 6 is a schematic representation of an alternative structure for the modal beamformer constellation of evaluation circuit 19 as described above in connection with FIG. 4. In circuit 19*a* of FIG. 6, the central omnidirectional microphone 1 of the microphone array of FIG. 2 is not evaluated and can thus be omitted. Instead of the pairs of microphones that form differential microphone constellations in connection with the central omnidirectional microphone 1, namely the pairs of microphones 5 and 1; 6 and 1; 7 and 1; 8 and 1; 9 and 1; and 10 and 1; pairs are formed from the six microphones 5-10 (e.g., pairs of microphones arranged opposite each other in relation to the center of the sphere, i.e., pairs of microphones 5 and 7; 6 and 8; 7 and 5; 8 and 6; 9 and 10; and 10 and 9, in order to form six corresponding differential microphone constellations.

In the configuration shown in FIG. 6, the alternative differential microphone constellation 19*a* includes two delaying signal paths for each one of the microphones 5-10 to generate two delayed output signals of the respective microphones. The six first delaying signal paths each include one of the delay paths 45-50, each having a delay time Ts, and one of delays 52, 53, 56, 57, 60 and 61, each having a delay time Tf. The six second delaying signal paths each include one of delay paths 51, 54, 55, 58, 59 and 62, each having a delay time of Td. In the present example, the delays 52, 53, 56, 57, 60 and 61 are fractional-delay FIR filters that provide delay time Tf.

Differential microphone constellation 19*a* of FIG. 6 further includes subtraction nodes 63-68 that generate directional output signals based on differences between the output signals of the six pairs of microphones 5 and 7; 6 and 8; 7 and 5; 8 and 6; 9 and 10; and 10 and 9, in which the first microphone of a pair may be delayed by the first delay path and the second microphone of a pair may be delayed by the second delay path.

Differential microphone constellation 19*a* of FIG. 6 may further include filter paths 69-74 that filter, with transfer function W(z), the first directional output signals provided by the subtraction nodes 63-68 to provide second directional output signals. The filter paths 69-74 may include low-pass filters or otherwise may exhibit low-pass behavior.

In the exemplary differential microphone constellation 19*a* of FIG. 6, the second directional output signals, again referred to as $X_{-Diff}$, $Z_{+Diff}$, $Y_{+Diff}$, $X_{+Diff}$, $Z_{-Diff}$ and $Y_{-Diff}$, corresponding to microphones 9, 5, 6, 10, 7 and 8, respectively, can be again expressed as set forth in equations (3) through (8).

In differential microphone constellation 19*a* of FIG. 6, the delay T for the output signal of microphone 1 is again split into two partial delays, the sample delay TS and the fractional delay $T_F$.

Sound capture systems as described above, with reference to FIGS. 2, 4, 5 and 6, enable accurate control over the beampattern in 3-D space. In addition to pencil-like beams, this system can also provide multi-direction beampatterns or toroidal beampatterns giving uniform directivity in one plane (e.g., cardioid, hypercardioid, bi-directional or omnidirectional characteristics). These properties can be useful for applications such as general multichannel speech pickup, video conferencing or direction of arrival (DOA) estimation. They can also be used as analysis tools for room acoustics to measure directional properties of the sound field.

The sound capture system shown supports decomposition of the sound field into mutually orthogonal components, the eigenbeams (e.g., spherical harmonics) that can be used to reproduce the sound field. The eigenbeams are also suitable for wave field synthesis (WFS) methods that enable spatially accurate sound reproduction in a fairly large volume, allowing reproduction of the sound field that is present around the recording sphere. This allows all kinds of general real-time spatial audio applications.

This allows, for example, for steering the look direction, adapting the pattern according to the actual acoustic situation and/or zooming in to or out from an acoustic source. All this can be done by controlling the beamformer, which may be implemented in software, such that no mechanical alteration of the micro-phone array is needed. In the present example, steering constellation 42 follows decomposer 40, correction constellation 43 follows steering constellation 42 and at the end is the summation constellation 44. However, it is also possible to have the correction constellation before the steering constellation. In general, any order of steering constellation, pattern generation and correction is possible, as beamforming constellation 19*b* forms a linear time invariant (LTI) sys-tem.

Furthermore, the microphone outputs or the differential microphone constellation outputs may be recorded and the modal beamforming may be performed by way of the recorded output signals at a later time or at later times to generate any desired polar pattern(s).

To achieve all this, no space-consuming, expensive unidirectional microphones are necessary, but only omnidirectional microphones, which are more advantageous in both size and cost.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A sound capture system comprising:

an open-sphere microphone array, where at least four omnidirectional microphones providing at least four output signals are disposed around a point of symmetry; and an evaluation circuit that is connected to the at least four omnidirectional microphones disposed around the point of symmetry and that is configured to superimpose an output signal of each of the at least four omnidirectional microphones disposed around the point of symmetry with an output signal of one of other microphones to form at least four differential microphone constellations providing at least four output signals, each differential microphone constellation having an axis along which it exhibits maximum sensitivity.

2. The sound capture system of claim 1 further comprising:

a first omnidirectional microphone that provides a first output signal and that is disposed at the point of symmetry, where the evaluation circuit is further connected to the first omnidirectional microphone disposed at the point of symmetry and is configured to superimpose the output signal of each of the at least four omnidirectional microphones disposed around the point of symmetry with the first output signal of the first omnidirectional microphone disposed at the point of symmetry to form at least four differential microphone constellations providing at least four output signals.

3. The sound capture system of claim 2 where the evaluation circuit comprises:

a first delay path configured to delay the output signal from the first omnidirectional microphone disposed at the point of symmetry to generate a delayed output signal of the first omnidirectional microphone disposed at the point of symmetry; and first subtraction nodes configured to generate first directional output signals based on differences between the output signals of the at least four omnidirectional microphones disposed around the point of symmetry and the delayed output signal of the first omnidirectional microphone disposed at the point of symmetry.

4. The sound capture system of claim 3 where the evaluation circuit further comprises:

second delay paths configured to delay the output signals from the at least four omnidirectional microphones disposed around the point of symmetry to generate delayed output signals of the at least four omnidirectional microphones disposed at the point of symmetry, the delayed output signals of the at least four omnidirectional microphones disposed around the point of symmetry being provided to first subtraction nodes.

5. The sound capture system of claim 4 where the evaluation circuit further comprises:

a third delay path configured to further delay the output signal from the first omnidirectional microphone disposed at the point of symmetry to generate a delayed output signal.

6. The sound capture system of claim 5 where the evaluation circuit employs digital signal processing under a sampling rate, and the first delay path and the second delay paths have a delay time that is a whole-number multiple of an inverse sampling rate.

7. The sound capture system of claim 5 where the evaluation circuit employs digital signal processing under a sampling rate, and the third delay path has a delay time that is a whole-number multiple of an inverse sampling rate.

8. The sound capture system of claim 4 where the evaluation circuit further comprises:

filter paths configured to filter first directional output signals provided by the first subtraction nodes to provide second directional output signals.

9. The sound capture system of claim 8 where the filter paths comprise low-pass filters.

10. The sound capture system of claim 2 where:

the at least four omnidirectional microphones include six omnidirectional microphones disposed around the point of symmetry;

four of the six omnidirectional microphones disposed around the point of symmetry and the first omnidirectional microphone disposed at the point of symmetry are arranged in a first plane;

the other two of the six omnidirectional microphones disposed around the point of symmetry and the first omnidirectional microphone disposed at the point of symmetry are arranged in a second plane; and the first plane and second plane are arranged perpendicular to each other.

11. The sound capture system of claim 10 where:

the first omnidirectional microphone disposed at the point of symmetry and the four of the six omnidirectional microphones that are disposed around the point of symmetry and arranged in the first plane are coplanar; and the two of the six omnidirectional microphones that are disposed around the point of symmetry and arranged in the second plane are coplanar.

12. The sound capture system of claim 1 where the evaluation circuit is further configured to superimpose the at least four output signals provided by the at least four differential microphone constellations to form a modal beamformer constellation.

13. The sound capture system of claim 12 where the modal beamformer constellation is configured to:

receive the at least four output signals provided by the at least four differential microphone constellations;

transform the at least four output signals provided by the at least four differential microphone constellations into spherical harmonics; and steer the spherical harmonics to provide steered spherical harmonics.

14. A sound capture system comprising:

an open-sphere microphone array including at least four omnidirectional microphones that provide at least four output signals, the at least four omnidirectional microphones being disposed around a point of symmetry; and an evaluation circuit that is connected to the at least four omnidirectional microphones disposed around the point of symmetry and that is configured to superimpose an output signal of each of the at least four omnidirectional microphones disposed around the point of symmetry with an output signal of one of the other microphones to form at least four differential microphone constellations providing at least four output signals, each differential microphone constellation having an axis along which it exhibits maximum sensitivity.

15. The sound capture system of claim 14 further comprising:

a first omnidirectional microphone that provides a first output signal and that is disposed at the point of symmetry, where the evaluation circuit is further connected to the first omnidirectional microphone disposed at the point of symmetry and is configured to superimpose the output signal of each of the at least four omnidirectional microphones disposed around the point of symmetry with the first output signal of the first microphone disposed at the point of symmetry to form at least four differential microphone constellations providing at least four output signals.

16. The sound capture system of claim 15 where the evaluation circuit comprises:

a first delay path configured to delay the output signal from the first omnidirectional microphone disposed at the point of symmetry to generate a delayed output signal of the first omnidirectional microphone disposed at the point of symmetry; and first subtraction nodes configured to generate first directional output signals based on differences between the output signals of the at least four omnidirectional microphones disposed around the point of symmetry and the delayed output signal of the first omnidirectional microphone disposed at the point of symmetry.

17. The sound capture system of claim 16 where the evaluation circuit further comprises:

second delay paths configured to delay the output signals from the at least four omnidirectional microphones disposed around the point of symmetry to generate delayed output signals of the at least four omnidirectional microphones disposed at the point of symmetry, the delayed output signals of the at least four omnidirectional microphones disposed around the point of symmetry being provided to first subtraction nodes.

18. The sound capture system of claim 17 where the evaluation circuit further comprises:

a third delay path configured to further delay the output signal from the first omnidirectional microphone disposed at the point of symmetry to generate a delayed output signal.

19. The sound capture system of claim 18 where the evaluation circuit employs digital signal processing under a sampling rate, and the first delay path and the second delay paths have a delay time that is a whole-number multiple of an inverse sampling rate.

20. A method for sound capture, the method comprising:

providing an open-sphere microphone array including at least four omnidirectional microphones that provide at least four output signals, the at least four omnidirectional microphones being disposed around a point of symmetry; and superimposing an output signal of each of the at least four omnidirectional microphones disposed around the point of symmetry with an output signal of one of the other microphones to form at least four differential microphone constellations providing at least four output signals, each differential microphone constellation having an axis along which it exhibits maximum sensitivity.

* * * * *